US008678248B2

(12) United States Patent
Davideit et al.

(10) Patent No.: US 8,678,248 B2
(45) Date of Patent: Mar. 25, 2014

(54) METERING VALVE

(75) Inventors: Daniel E. Davideit, Manchester, NH (US); Kevin G. Verville, Manchester, NH (US)

(73) Assignee: Summit Packaging Systems Inc, Manchester, NH (US)

( * ) Notice: Subject to any disclaimer, the term of this patent is extended or adjusted under 35 U.S.C. 154(b) by 1346 days.

(21) Appl. No.: 11/953,919

(22) Filed: Dec. 11, 2007

(65) Prior Publication Data

US 2009/0145932 A1 Jun. 11, 2009

(51) Int. Cl.
*B65D 83/06* (2006.01)
*B65D 83/54* (2006.01)

(52) U.S. Cl.
CPC ..... *B65D 83/546* (2013.01); *B65D 83/54* (2013.01)
USPC ..... 222/402.2; 222/402.24; 222/542

(58) Field of Classification Search
CPC ..... B65D 83/48
USPC ..... 222/402.1, 402.2, 402.24, 542; 251/121, 364; 277/435, 437, 502, 549, 277/560, 585
See application file for complete search history.

(56) References Cited

U.S. PATENT DOCUMENTS

| | | | | |
|---|---|---|---|---|
| 3,003,662 A | | 10/1961 | Meshberg | |
| 3,033,473 A | * | 5/1962 | Kitabayashi | 222/402.24 |
| 3,048,306 A | * | 8/1962 | Boegly | 222/402.24 |
| 3,187,962 A | * | 6/1965 | Meshberg | 222/402.2 |
| 3,235,135 A | * | 2/1966 | Blanie et al. | 222/402.2 |
| 3,464,596 A | * | 9/1969 | Meshberg | 222/402.2 |
| 3,581,946 A | * | 6/1971 | Meshberg | 222/136 |
| 3,958,727 A | * | 5/1976 | Steiman | 222/402.24 |
| 4,034,899 A | * | 7/1977 | Meshberg | 222/402.2 |
| 4,230,242 A | * | 10/1980 | Meshberg | 222/321.2 |
| 4,577,784 A | * | 3/1986 | Brunet | 222/402.2 |
| 4,858,790 A | * | 8/1989 | Howlett | 222/402.2 |
| 4,919,312 A | | 4/1990 | Beard et al. | |

(Continued)

FOREIGN PATENT DOCUMENTS

| | | |
|---|---|---|
| DE | 2516212 | 7/1976 |
| EP | 0125865 | 11/1984 |
| FR | 2559567 | 8/1985 |
| GB | 2216872 | 10/1989 |

OTHER PUBLICATIONS

International Search Report dated Mar. 26, 2009 and the Written Opinion dated Jun. 11, 2010 received in International Patent Application No. PCT/US2012/24481 published as WO 2009/076507.

*Primary Examiner* — J. Casimer Jacyna
(74) *Attorney, Agent, or Firm* — ZIP Law PLLC; Claire Zopf

(57) ABSTRACT

A metering valve having a contiguous double wall structure including an inner wall defining the metering chamber and an outer wall which defines a crimping and support wall against which the inner rim of the mounting cup of the container can be crimped. The outer wall may be maintained at the same diameter and thickness for use with generally any mounting cup which are approximately an inch in diameter as well as any mounting process and machinery. The inner wall may however be sized differently in order to accommodate different dosages for metering of product. A radial space between the inner and outer wall permits the both the axial elongation of the metering chamber as well as a radial expansion of the inner wall and hence the valve chamber relative to the outer wall due to the space between the inner and outer wall.

14 Claims, 7 Drawing Sheets

(56) References Cited

U.S. PATENT DOCUMENTS 5,037,013 A 8/1991 Howlett
5,697,532 A * 12/1997 Wilde et al. ..... 222/402.2
5,769,283 A 6/1998 Owada et al.
6,581,807 B1 * 6/2003 Mekata ..... 222/402.1
6,832,704 B2 12/2004 Smith
6,926,178 B1 * 8/2005 Anderson ..... 222/402.2
6,978,916 B2 12/2005 Smith
7,900,932 B2 * 3/2011 Leimer et al. ..... 277/502

* cited by examiner

METERING VALVE

FIELD OF THE INVENTION

This invention relates to a metering valve for dispensing a pressurized product, generally an aerosolized liquid from a spray can type container where a discrete, metered dosage is dispensed each time a user actuates the metering valve.

BACKGROUND OF THE INVENTION

Metering valves for spray cans are readily available in the marketplace which are constructed to allow a discrete, or pre-proportioned amount of product to be dispensed at each actuation of the valve control push-button. Such metering valves generally comprise a valve body which is associated in a sealed relationship with the mounting cup of the container or can by means of a folded seam or crimped collar. Within the valve body is defined a valve chamber in which an axially slidable valve stem is pushed down by a user against the bias of a valve spring.

Inside the valve chamber there is generally a lower inlet which may include a ring seal adjacent the inlet, where the ring seal is adapted for circumferential engagement with the valve stem, in contact relationship therewith, when the valve stem is in its dispensing position. Upon actuation of the valve stem the metering chamber is isolated from the main reservoir of the container and placed in communication with the outside environment to define a dispensing state. When the stem is released, the valve chamber again communicates with the main reservoir to permit the valve chamber to be recharged and cuts off communication with the outside environment.

A drawback associated with prior art metering valves is that such valves have a tendency to "throttle". That is, due to a poor or an improper valve design, it is possible for an operator to partially depress the valve stem and establish a product flow path from the interior cavity of the aerosol container through the metering valve and out through a spray button or actuator affixed to the stem of the aerosol valve, prior to the valve stem sealing the inlet to the valve housing, so that product may be continuously discharged out through the aerosol valve. As a result of such "throttling", the operator is able to dispense a continuous discharge of product from the aerosol container via the metering valve rather than meter a desired amount. This results in the inadvertent discharge of excess product form the aerosol container which is wasteful and generally to be avoided.

Some prior art designs utilize a frictional sealing fit between two plastic valve components to separate the contents of the container from the metering chamber. This arrangement requires that a valve spring, accommodated by the valve, be sufficiently forceful to overcome the interference fit of this sealing device upon the valve closing sequence. Apart from being subject to size and hardness changes due to immersion in the product, this design mandates extremely close tolerances of the mating components and critical alignment of molded parts during the valve assembly operation. Also, insufficient return force, or pre-load, on the valve spring can cause failure of the valve stem to return to an initial closed position after initial depression. Failure to observe these manufacturing tolerances, pre-load and alignment criteria leads to an inaccurate metered spray or a valve which will not "shut-off" and thus result in the total release or dispensing of the entire product contents.

It is to be appreciated that such metering valves must be manufactured so as to accommodate different volumes of product which a manufacturer desires to dispense with each actuation. With the known metering valves, it happens that, where the useful volume of the metering chamber is to be changed, i.e., when it is desired to change the amount of product dispensed at each actuation, the cylindrical valve body must be entirely redesigned and manufactured with such a volume in mind and/or replaced as a whole.

It follows therefore, that in order to change the dispensed proportion of product the valve body must be entirely remanufactured with the thickness of the valve body walls being adjusted thicker or thinner, and/or the length of the entire metering valve body being changed and the majority of the metering valve components also have to be replaced with others having different dimensions which creates a problem both as regards to production and inventory.

Also, it is well known in the industry that inadequate sealing engagement and material incompatibility between the valve stem and the seal ring, and/or the valve chamber inlet, when the valve is actuated can lead to very undesirable results of inadvertent over-dispensing of the product as the product leaks from the container reservoir through the poor seal between around the valve stem and into the valve chamber during an actuated state of the valve.

OBJECTS AND SUMMARY OF THE INVENTION

Wherefore, it is an object of the present invention to overcome the above noted drawback associated with the prior art aerosol metering valves.

Yet another object of the present invention is to provide a metering valve assembly which reliably, consistently and accurately dispenses a desired quantity of the product contents from the metering valve assembly.

A still further object of the present invention is to provide a metering valve assembly which can be reliably manufactured while minimizing the degree of inspection required for manufacture of the metering valve assembly.

A further object of the present invention is to provide a metering valve assembly which prevents inadvertent "throttling" of the metering valve assembly by an operator.

Yet another object of the present invention is to provide a metering valve assembly which is securely affixed to the valve housing and, following insert of the valve housing onto a container, the metering valve assembly establishes a flow path with the internal cavity of the container to facilitate pressuring of the container with the product to be dispensed during the manufacturing process.

The general operation of this metering valve is similar to that of conventional valves. With the stem in an upper position biased by the valve spring, the metering chamber is in communication with a container reservoir or interior and consequently the product flows into and fills the metering chamber. By depressing the stem with a depressing action which overcomes the bias of the valve spring, the stem is moved downwards to engage and shut off the communication between the metering chamber and the interior of the container. At a point following establishment of a seal between the tail piece of the valve stem and the seal ring, the valve stem is moved further downwards so that the metering chamber now communicates with the radial holes in the valve stem which allow the product to be dispensed out through the main passageway of the valve stem and into the atmosphere. The timing between the initial sealing of the metering chamber from the product reservoir and the dispensing of the product is critical since if the seal is not established before the product is dispensed, the accuracy of the metering valve is compromised.

The present invention utilizes a contiguous double wall structure including an inner wall defining the metering chamber and an outer wall which defines a crimping and support wall against which the inner rim of the mounting cup of the container can be crimped. The importance of the connected inner and outer walls is that the outer wall may be maintained at the same diameter and thickness for use with generally any mounting cup which are approximately an inch in diameter as well as any mounting process and machinery. The inner wall may however be sized differently in order to accommodate different dosages for metering of product. Importantly there is a radial space between the inner and outer wall which permits both the axial elongation of the metering chamber as well as a radial expansion of the inner wall and hence the valve chamber relative to the outer wall due to the space between the inner and outer wall.

Additionally, the present invention utilizes a seal ring placed in the bottom of the inner chamber which has an inner, intermediate embossment formed in the inner wall thereof. The seal ring is made of a relatively flexible material such as polyethylene as compared with the valve body and the seal ring and intermediate embossment acts in cooperation with a cylindrical tail end of the stem in order to create a sealed engagement between the protuberance and the valve stem when the valve stem is in the depressed i.e. actuated position so that fluid cannot communicate from the main chamber into the valve chamber. The embossment and seal ring also facilitates a release of the sealed engagement when actuating pressure on the valve stem is released and the valve spring axially biases the stem into the upward position so that product from within the container can now communicate and refill, i.e., charge the metering chamber for the next dose.

DETAILED DESCRIPTION OF THE PREFERRED EMBODIMENTS

Figure 1:
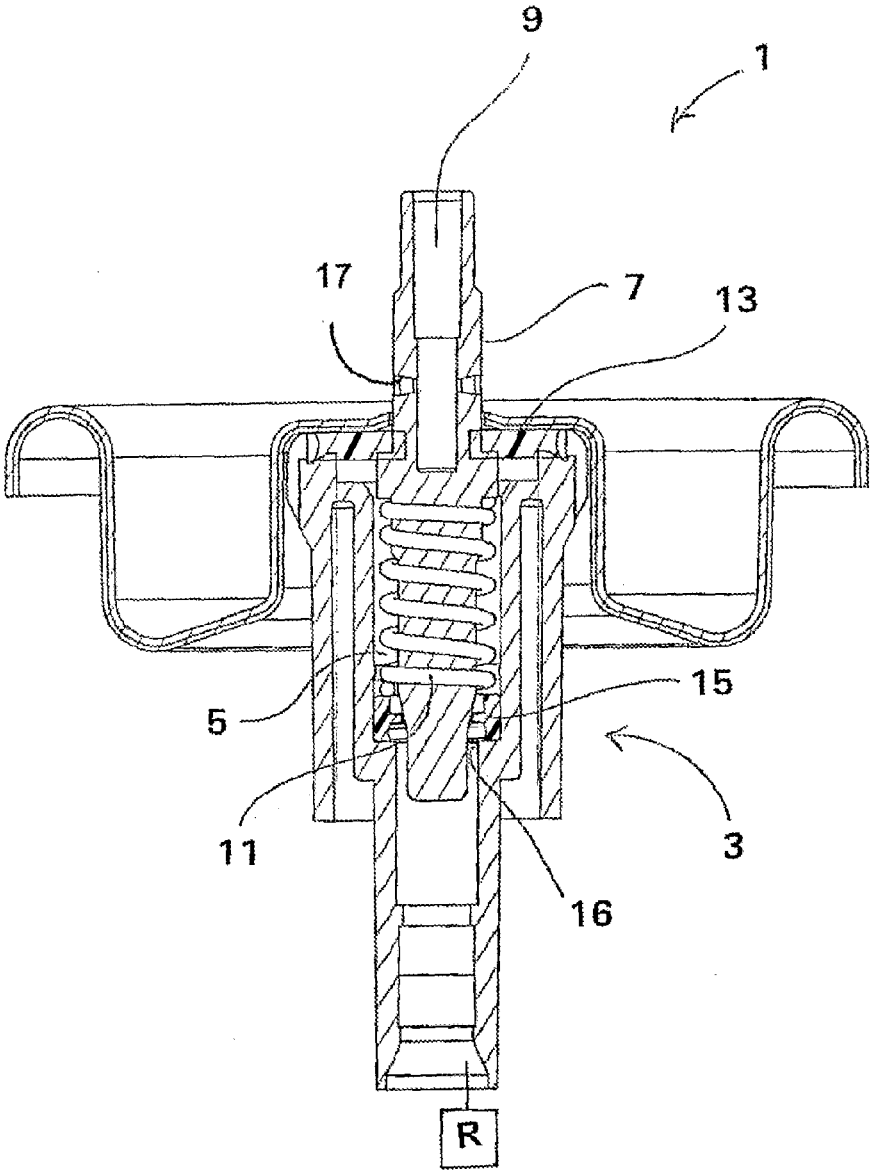
FIG. 1 is a cross sectional elevation view of the metering valve 1 of the present invention in an unactuated state.
Figure 2:
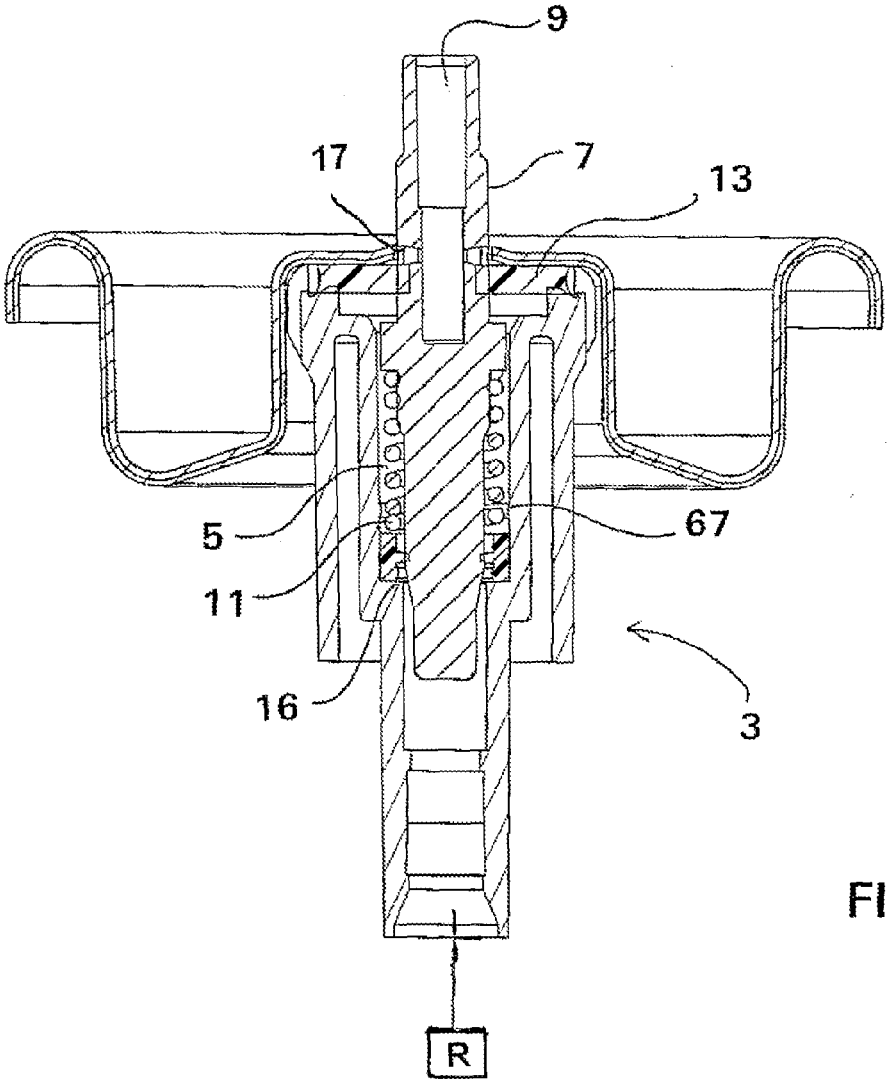
FIG. 2 is a cross sectional elevation view of the metering valve 1 in an intermediate state where the lower seal is engaged, but product is not yet dispensed.
Figure 3:
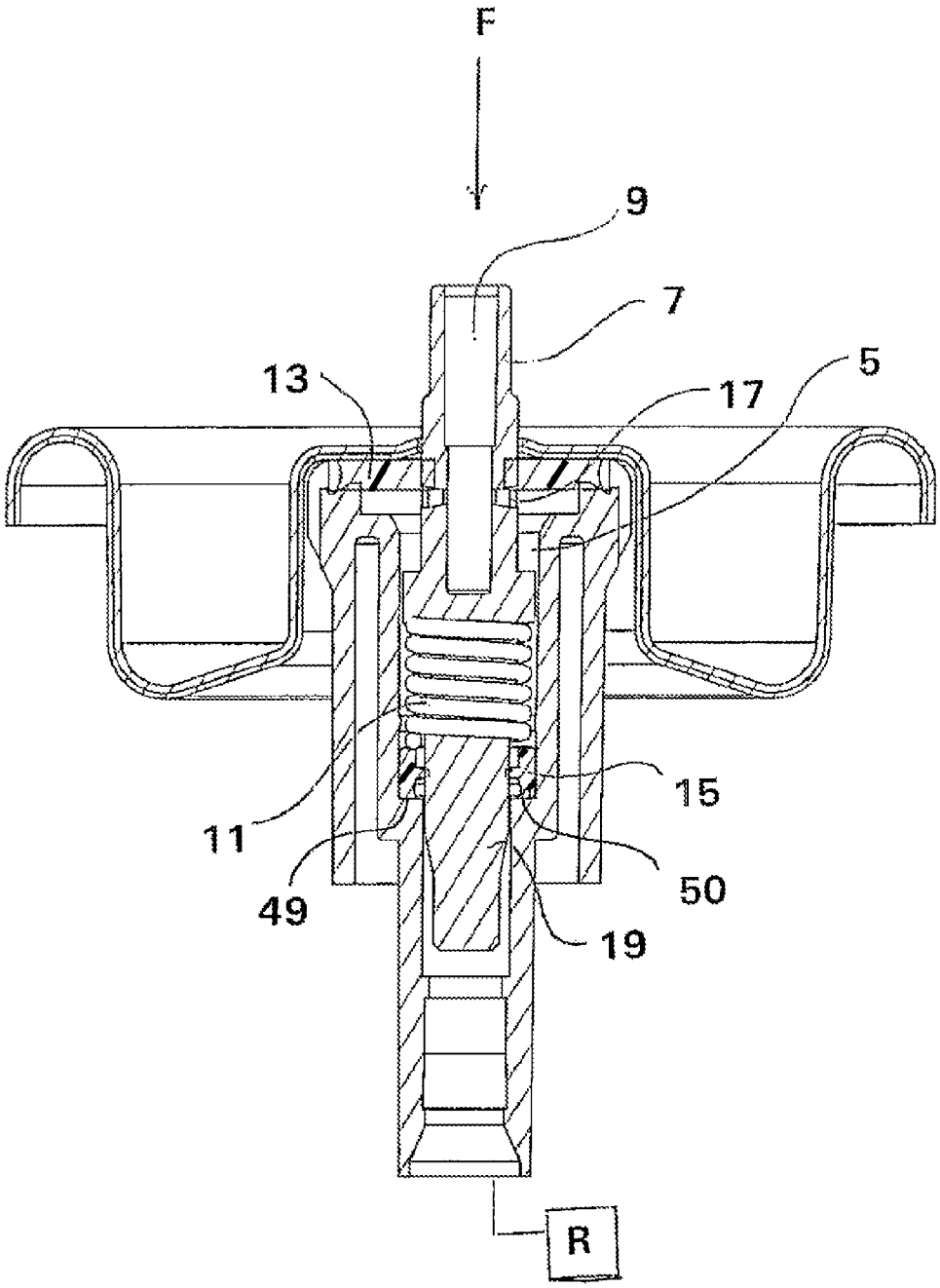
FIG. 3 is a cross sectional elevation view of the metering valve 1 in an actuated or depressed state.

FIGS. 1-3 show a metering valve 1 of the present invention for a product which is pressurized within a main reservoir R of a container or can (not shown). In general, the metering valve 1 includes a valve body 3 defining a valve chamber 5, a valve stem 7 having a main passageway 9 for expelling the pressurized product from the metering valve 1 chamber, and a valve spring 11 for biasing the valve stem 7 against an upper gasket 13 of the metering valve 1. Also, a seal ring 15 is positioned at the bottom of the metering valve 1 chamber adjacent a product inlet 16 to the valve chamber 5 and surrounding the valve stem 7 in order to prevent passage or leakage of product from the inlet into the valve chamber 5 when the valve is in a product dispensing state.

The valve works in the following manner, with the seal ring 15 inserted into the valve chamber 5, the valve spring 11, generally a compression spring, sits on a top surface 47 of the seal ring 15 and, according to a desired pre-load, provides an upward bias to the valve stem 7. Consequently, the valve spring 11 and the pre-load compression also causes a face seal between the outer surfaces of the seal ring 15 and the inner surfaces of the valve chamber 5 to prevent the leakage or passage of product or gas around the seal ring 15. In the closed state shown in FIG. 1, as opposed to the product dispensing state in FIG. 3, the valve stem 7 is maintained by the valve spring 11 so that the stem inlets 17 which allow product into the main passage of the valve stem 7 are above, and separated from the valve chamber 5 by the upper gasket 13. In this closed state, a tail piece of the valve stem 7 is spaced from the seal ring 15 and the lower portion of the metering valve chamber 5 communicates directly with the product inlet 16 so that product from the reservoir of the can or container may enter into the valve chamber 5 and thus charge the metering valve 1.

In the product dispensing state, a force F as shown in FIG. 2 is applied to the valve stem 7 and the valve stem 7 is forced or pushed downward against the upward bias of the valve spring 11. Initially, when the valve stem 7 is pushed down, i.e. actuated, the tail portion 19 of the valve stem 7 comes into radial contact with the seal ring 15 to block, or cut off, the metering valve chamber 5 from the product inlet 16 and the main product reservoir R in the container. Subsequent to the establishment of this seal between the seal ring 15 and the tail portion 19 of the valve stem 7, the stem inlets 17 connected to the main passageway 9 of the valve stem 7 are lowered below the upper gasket 13 and into the valve chamber 5 itself. Now, as seen in FIG. 3, the product which is contained and isolated and under pressure in the valve chamber 5 due to the radial engagement between the seal ring 15 and the tail portion 19 of the valve stem 7 is expelled from the valve chamber 5 through the valve stem 7 inlets and dispensed to the user out the valve stem 7 main passageway 9.

When the user removes force F from the valve stem 7, the compression spring returns the valve stem 7 to the closed state of the valve where the stem inlets 17 slide by the upper gasket 13 and out of communication with the valve chamber 5. Subsequently, the tail portion 19 of the valve stem 7 is raised out of contact with and above the seal ring 15 so that pressurized product is then again permitted to flow through the product inlet 16 and into the chamber 5 from the main reservoir R. Thus, the valve chamber 5 is again charged with pressurized fluid awaiting the next depressive force of the valve stem 7 by the user.

Figure 4:
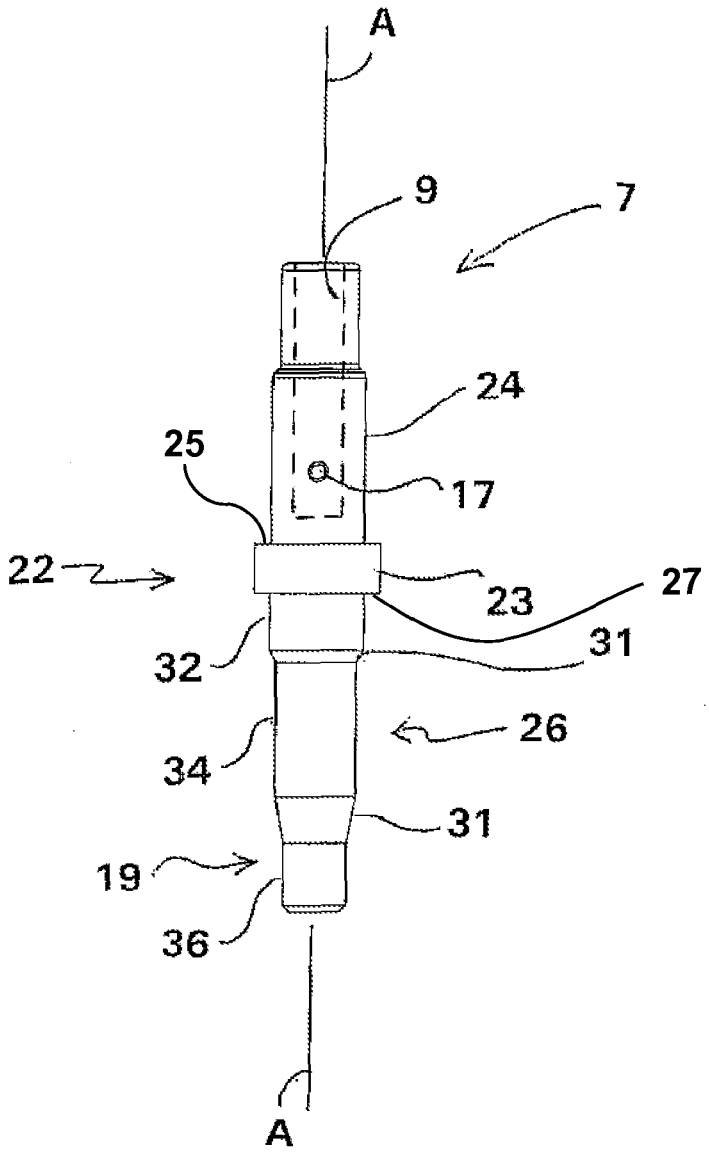
FIG. 4 is an elevation view of the valve stem 7 of the metering valve 1.

Now in further detail, turning to FIG. 4 the valve stem 7 is defined about a longitudinal axis A and has an upper portion 24, an intermediate portion 22 and a lower portion 26. The upper portion 24 includes the valve stem inlets 17 and the main passageway 9 leading to a valve stem 7 outlet where the product is dispensed. The valve stem inlets 17 are generally formed perpendicular to the main passageway 9 and the longitudinal axis A and communicate directly with the main passage coaxial along the axis A and extending from an intermediate portion 22 of the valve stem 7 to the valve stem 7 outlet.

The valve stem 7 is also provided with an external embossment 23 at the intermediate portion 22 of the valve stem 7. The embossment 23 provides an upper step 25 and a lower step 27 where the lower step 27 provides a surface against which the top end of the spring abuts so as to influence the valve stem 7. The upper step 25 of the embossment 23 provides a surface which abuts against a lower surface of the upper gasket 13 when the valve stem 7 is in the closed state.

The tail portion 19 of the valve stem 7 is formed on the lower portion 26 of the valve stem 7. The tail portion 19 may include two or three constant diameter cylindrical sections separated by tapered sections a largest section 32, a middle section 34 and a smallest end section 36. The cylindrical sections are each of a different diameter with largest section 32 adjacent to the intermediate portion 22 of the valve stem 7 is substantially the same diameter as the inner diameter of the valve spring 11 in order to frictionally engage the spring 11 and maintain its relative radial and axial position on the valve stem 7 and in the valve chamber 5. The middle section 34 is sized so as to provide a particularly close interference fit with the seal ring 15 and isolate the valve chamber 5 from the product inlet 16 and main reservoir R when the valve is in the product dispensing state.

The end section 36 of the tail portion 19 has a diameter that is slightly smaller than the inner most diameter of the seal ring 15 in order to provide a spacing therebetween for product flow from the main product reservoir through the product inlet 16 into the metering valve 1 chamber when the valve is in the closed state as described above. The taper section 31 between the middle section 34 and the smallest end section 36 of the tail portion 19 ensures a smooth transition between the cylindrical sections 29 occurs during the sliding interfering contact between the seal ring 15 and the tail portion 19. In other words, when the valve is actuated as in FIG. 3 the tail portion 19 slides relative to the seal ring 15 so that the tapered section passes downward through the seal ring 15 and provides a smooth and consistent sliding transition to the interference fit between the seal ring 15 and the middle section 34 of the tail portion 19.

Figures 5A, 5B:
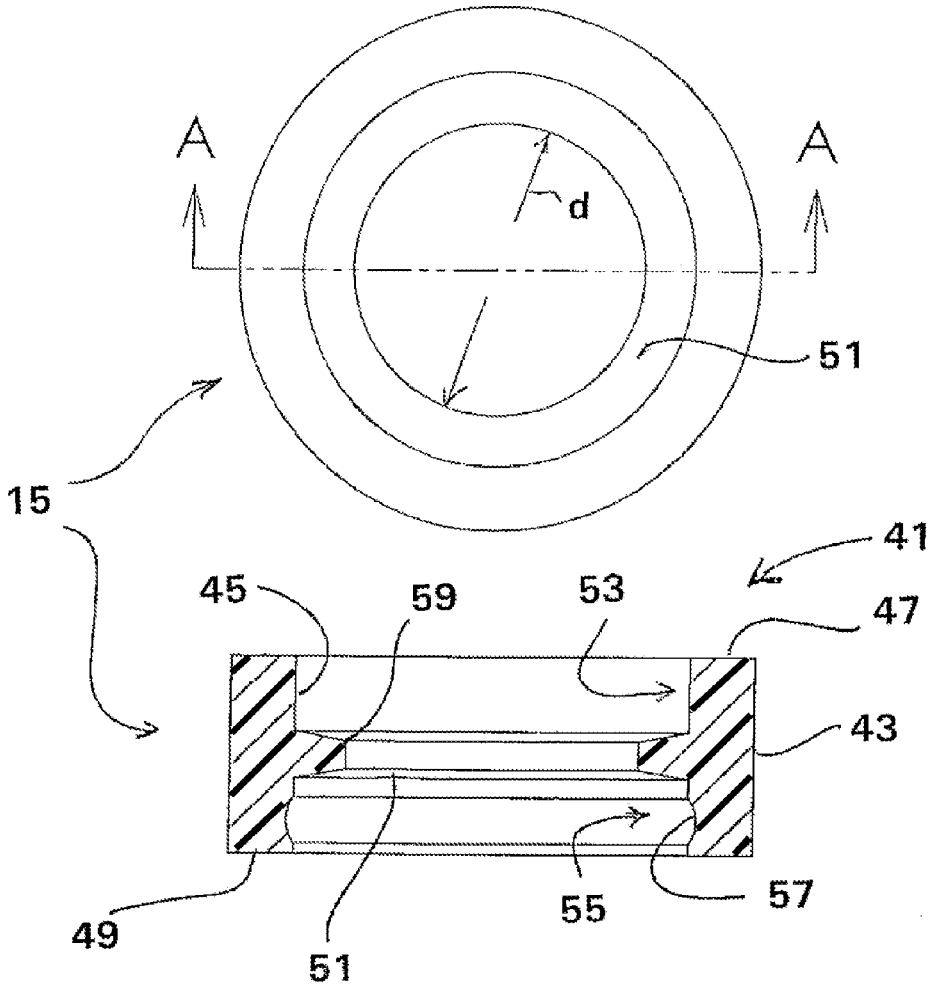
FIGS. 5A and 5B are a top plan view and cross-section view respectively of the seal ring 15.

Better seen in FIGS. 5A-5B, the seal ring 15 is fabricated from a particularly softer and generally more elastic material than the harder and stiffer polymers used in making the valve stem 7 and the metering valve 1 body. The seal ring 15 may be fabricated for example out of polyethylene. The seal ring 15 is defined by a hollow cylindrical main body 41 having an outer surface 43 with a substantially flat profile to frictionally engage with a wall of the valve chamber 5, an inner surface 45 for radially engaging with the tail portion 19, a top surface 47 and a bottom surface 49. The seal ring 15 is positioned inside the metering valve 1 chamber so that the bottom surface 49 is in contact with a corresponding bottom surface 50 of the metering valve 1 chamber to form a face seal therebetween maintained by the pre-load of the valve spring 11 and the outer surface 43 rests against the inner wall of the metering valve 1 chamber and the bottom end of the valve spring 11 sits atop the top surface 47 of the seal ring 15.

The inner surface 45 of the seal ring 15 is further formed with a circumferential inner embossment 51 which facilitates the sealing of the passage through the seal ring 15. It is this inner embossment 51 which generally provides the frictional engagement and interference fit with the above discussed components i.e. the tail portion 19 and middle section 34 of the valve stem 7. Where the inner diameter d of the inner embossment 51 is approximately 0.100-0.110 inch and more preferably about 0.102-0.105 inch, the inner diameter of the remaining portion of the seal ring 15 is about 0.100-0.150 and more preferably about 0.135-0.145 inch. The diameter of the middle section 34 of the tail portion 19 is chosen so that a desired interference occurs between the inner embossment 51 of the seal ring 15 the tail portion 19 and the middle section 34 of the valve stem 7 to create the lower seal between the valve chamber 5 and the reservoir R.

Figure 5D:
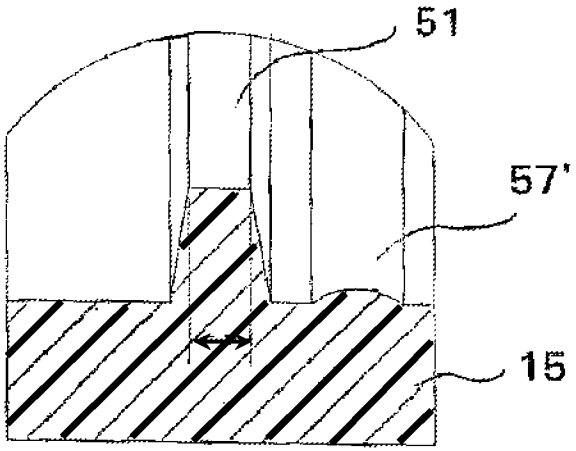
FIGS. 5C and 5D are a cross-sectional view of a second embodiment of the seal ring 15.
Figure 5C:
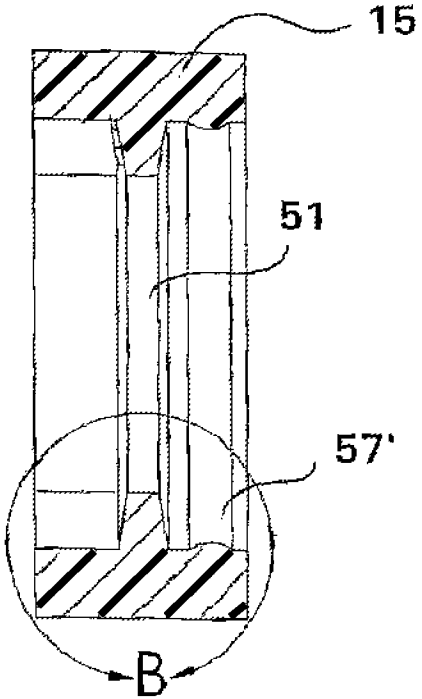

An upper portion 53 of the inner surface 45 of the seal ring 15 may be generally flat whereas the lower portion 55 of the inner surface 45 is shown having a substantially circumferentially concave curved surface 57 and is important in that the curved surface 57 facilitates mold extraction of the seal ring 15. It is to be appreciated that as shown in FIGS. 5C-D, the curved surface 57' may be convex in nature as well for the same reason.

The inner embossment 51 of the seal ring 15 is a radially inwardly extending protrusion from the inner surface 45 of the seal ring 15 towards the axis A of the valve. The inner embossment 51 tapers from a thicker portion adjacent and integrally connected to the inner surface 45 of the seal ring 15 to a thinner cylindrical free end 59 for contacting the valve stem 7 and defining the innermost diameter of the seal ring 15. This tapering profile is important to provide a relative flexibility to the free end 59 of the inner embossment 51 which seals, and unseals, with the middle section 34 of the valve stem 7 during actuation and release respectively. It is to be appreciated that other shapes and profiles for the inner embossment 51 may be utilized as well.

Figure 6A:
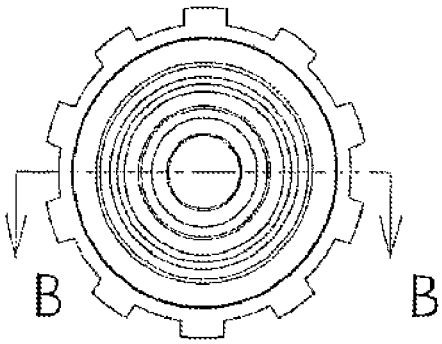
FIGS. 6A and 6B are a top plan view and cross-section view respectively of the valve body.
Figure 6B:
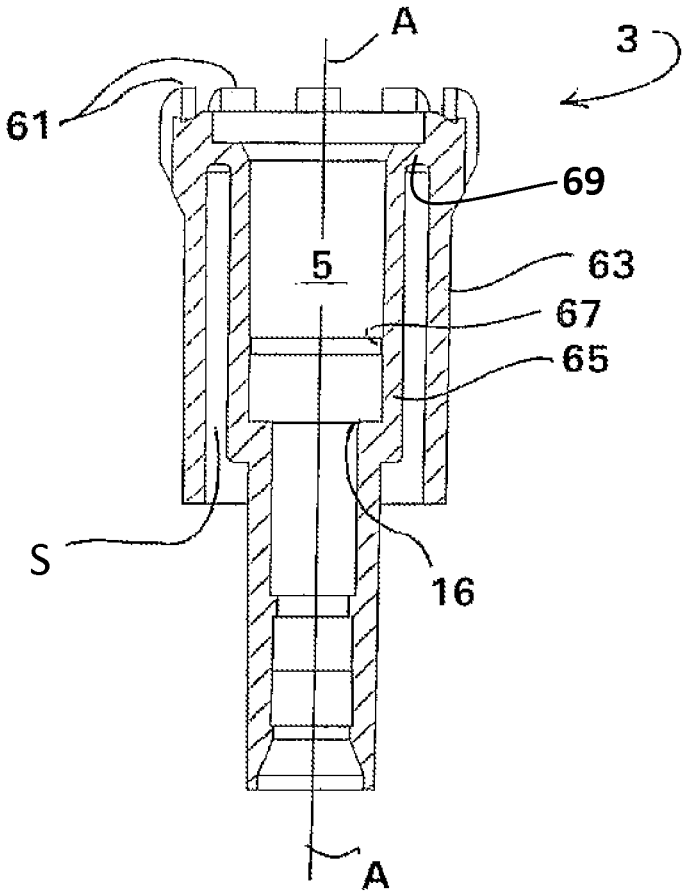

The metering valve body 3 shown in FIGS. 6A, 6B is composed of a series of castellations 61 along a top edge for direct engagement with the inner walls of the mounting cup to assist in crimping and to maintain the metering valve 1 body and valve stem 7 and other components in alignment and engagement with the mounting cup. These castellations 61 extend outwards having a larger diameter than a lower portion 55 of the metering valve body 3 in order to permit the crimping of the center turret of the mounting cup around and to the metering valve body and to provide for through-the-valve (TTV) filling.

The valve body 3 is defined by an outer wall 63 and an inner wall 65 where the inner wall 65 specifically defines the valve chamber 5 and is radially spaced from the outer wall 63 where the outer wall 63 is generally maintained at a desired circumference in order to provide the appropriate size and alignment of the castellations 61 for crimping to the mounting cup. This radial space S between the inner wall 65 and the outer wall 63 is important because it permits the inner wall 65 to be readily manufactured in a variety of diameters relative to the central axis A of the valve which would enable a manufacture to vary the size of the valve chamber 5 by moving the inner wall 65 of the valve body 3 in or out relative to the axis without moving the outer wall 63.

Thus, with the same outer dimensions, i.e. the outer wall 63 remaining the same for purposes of attachment and crimping to the mounting cup, the inner wall 65 may be varied in order to provide different volumes of valve chambers for particularly different products. The inner wall 65 defines the valve chamber 5 and a passage and an inlet passage leading thereto. The inlet passage is generally of a smaller diameter and connects with the valve chamber 5 at a step portion against forming the bottom wall of the valve chamber 5 against which the seal ring 15 abuts. The inner wall 65 of the valve body 3 extends upward generally at a larger diameter than the inlet passage 16 in order to define the metering chamber 5. Besides being radially expandable depending of the product to be used, this metering chamber 5 may also be made longer or shorter, i.e. extending a longer or shorter distance along the longitudinal axis A of the valve in order to further enlarge or reduce the volume of the chamber.

The valve spring 11 is situated between the lower step 27 formed by the intermediate embossment 23 on the valve stem 7 and the top surface 47 of the seal ring 15. Where the spring is in compression at all times after manufacture of the metering valve 1 and mounting cup, the pre-load on the spring will maintain the seal ring 15 in the face seal against the intermediate step of the metering valve 1 body at all times. Also, an inward extending chamber protrusion 67 assists in maintaining and setting the seal ring 15 in its appropriate position adjacent the inlet 16.

Since certain changes may be made in the above described and improved valve body 3 and fitment 1, 51 without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A metering valve for dispensing pressurized fluid, the metering valve comprising:

a valve body having an inner wall contiguously formed coaxially with an outer wall along a main axis A;

a radial space defined between the coaxial inner and outer walls along the length of the main axis;

a valve chamber defined within a circumference of the inner wall and an inlet into the valve chamber communicating with a connecting passage for communicating with a product reservoir;

a seal ring positioned in the valve chamber;

a valve stem;

a valve spring inserted into the valve chamber and between the seal ring and valve stem;

the seal ring is positioned adjacent the inlet to the valve chamber and the seal ring comprises a hollow cylindrical main body having an outer surface with a substantially flat profile to frictionally engage with a wall of the valve chamber and a radially inward extending embossment tapering to a cylindrical surface providing an interfering engagement with the valve stem; and wherein said seal ring is provided with one of a concave and convex inner surface axially spaced from below the inward extending embossment.

2. The metering valve as set forth in claim 1, wherein the seal ring is fabricated from a substantially softer material as compared with a harder material forming the valve body and valve stem.

3. The metering valve device set forth in claim 1, wherein the inwardly depending embossment of the seal ring comprises a radially inward extension having a thicker portion integrally connected with the seal ring and tapering to a free end for contacting the respective portion of the valve stem.

4. The metering valve device set forth in claim 3, wherein the inwardly depending embossment of the seal ring flexes relative to an inner wall of the seal ring when engaged by the valve stem during operation of the valve device.

5. The metering valve device set forth in claim 1 wherein the inner wall and the outer wall of the valve body are contiguously formed to define a radial space therebetween and the valve chamber is sized so as to accommodate the seal ring, valve spring and valve stem axially movable along the main axis A.

6. The metering valve as set forth in claim 1, wherein the inner wall is provided with a radially inwardly extending protrusion around the entire inner wall and spaced from the inlet in order to insure that the seal ring is maintained in a position between the inlet to the valve chamber and the inwardly extending protrusion.

7. The metering valve as set forth in claim 1 wherein the outer wall of the valve body has a first diameter and the inner wall has a second diameter smaller than the first diameter and wherein the first diameter is maintained constant the second diameter of the inner wall may be varied to form a valve chamber of various volumes.

8. The metering valve as set forth in claim 7, wherein the seal ring is fabricated from a substantially more elastic material as compared with a harder material forming the valve body and valve stem.

9. A metering valve for dispensing pressurized fluid comprising:

a valve body having an outer wall radially connected with an inner wall circumferentially extending about an axis, a radial space is defined between the inner and outer walls and a valve chamber is defined by the inner wall and an inlet into the valve chamber is formed to communicate with a product reservoir and permit the entrance of product into the valve chamber;

a seal ring positioned in the valve chamber, the seal ring comprises a hollow cylindrical main body having an outer surface with a substantially flat profile to frictionally engage with a wall of the valve chamber and the seal ring having a radially inward extending embossment comprising a tapered portion leading to a linear cylindrical surface for contacting a valve stem; and wherein said seal ring is provided with one of a concave and convex inner surface axially spaced from the inward extending embossment.

10. The metering valve for dispensing pressurized fluid as set forth in claim 9 wherein the seal ring is fabricated from a substantially more elastic material than the valve body.

11. The metering valve for dispensing pressurized fluid as set forth in claim 9 further comprising a valve stem and a valve spring inserted into the valve chamber between the seal ring and valve stem.

12. The metering valve for dispensing pressurized fluid as set forth in claim 11 wherein the metering valve comprises a first position wherein the valve stem is biased by the valve spring to define a passage between the valve stem and the seal ring, a second position wherein the valve stem is moved against the bias of the valve spring to close the passage and form the interfering engagement seal with the seal ring, and a third position wherein the interfering engagement seal is maintained and a valve stem passage is in fluid communication with the valve chamber.

13. The metering valve as set forth in claim 9 wherein the outer wall of the valve body is maintained with a constant diameter and the inner wall can be formed of a plurality of different diameters to achieve a valve chamber of various volumes.

14. A metering valve for dispensing pressurized fluid comprising:

a valve body having an outer wall radially connected with an inner wall circumferentially extending about an axis, a radial space is defined between the inner and outer walls and a valve chamber is defined by the inner wall and an inlet into the valve chamber is formed to communicate with a with a product reservoir and permit the entrance of product into the valve chamber;

a seal ring positioned in the valve chamber, the seal ring comprises a hollow cylindrical main body having an outer surface with a substantially flat profile to frictionally engage with a wall of the valve chamber and the seal ring having a radially inward extending embossment comprising a tapered portion leading to a linear cylindrical surface for contacting a valve stem;

wherein said seal ring is provided with one of a concave and convex inner surface axially spaced from the inward extending embossment;

the valve stem having a tail portion comprising a plurality of constant diameter cylindrical sections separated by a tapered section, a first cylindrical section is sized to provide a particularly close interference fit with the seal ring and isolate the valve chamber when the valve is in the product dispensing state, and a second cylindrical section of the tail portion has a diameter that is slightly smaller than an inner most diameter of the seal ring in order to provide a spacing therebetween for product flow from the main product reservoir into the metering valve chamber; and the tapered section between the first and second cylindrical sections ensures a smooth transition between the cylindrical sections occurs during the sliding interfering contact between the seal ring and the tail portion.

* * * * *